US006131485A

United States Patent [19]

Raja

[11] Patent Number: 6,131,485

[45] Date of Patent: Oct. 17, 2000

[54] FOOT PEDAL EXTENSION SYSTEM

[76] Inventor: Shaffaqat H. Raja, 3371 Galena Crescent, Mississauga, Ontario, Canada, L5A 3L7

[21] Appl. No.: 09/182,969

[22] Filed: Oct. 29, 1998

[51] Int. Cl.[7] ..... G05G 1/16

[52] U.S. Cl. ..... 74/562; 74/564; 180/334; 296/75

[58] Field of Search ..... 74/562, 562.5, 74/564; 180/334; 296/75

[56] References Cited

U.S. PATENT DOCUMENTS

| | | | |
|---|---|---|---|
| 1,981,148 | 11/1934 | Muench | 296/75 |
| 2,078,324 | 4/1937 | Griffiths | 74/562.5 |
| 2,341,080 | 2/1944 | Burkholder | 296/75 |
| 3,630,100 | 12/1971 | Lemak | 74/562 |
| 4,991,900 | 2/1991 | White | 296/75 |

FOREIGN PATENT DOCUMENTS

| | | | |
|---|---|---|---|
| 453600 | 12/1948 | Canada | 74/562.5 |
| 677448 | 3/1930 | France | 296/75 |
| 5-278512 | 10/1993 | Japan | 296/75 |
| 13894 | 11/1911 | United Kingdom | 296/75 |
| 536078 | 5/1941 | United Kingdom | 74/562 |

*Primary Examiner*—Lenard A. Footland
*Assistant Examiner*—Chong H. Kim

[57] ABSTRACT

A foot pedal extension system for permitting a short user to reach the foot pedals of a vehicle comfortably. The foot pedal extension system includes a foot pedal of a vehicle with a pivot arm and a foot pad coupled to a lower end of the pivot arm. The pivot arm of the foot pedal has an upper end pivotally coupled to the vehicle. An elongate extension arm has an inner end coupled to the pivot arm of the foot pedal between the upper and lower ends of the pivot arm. The extension arm is outwardly extended from the pivot arm of the foot pedal in a direction towards the foot pad of the foot pedal. An extension pad is coupled to an outer end of the extension arm located distal the inner end of the extension arm.

9 Claims, 3 Drawing Sheets

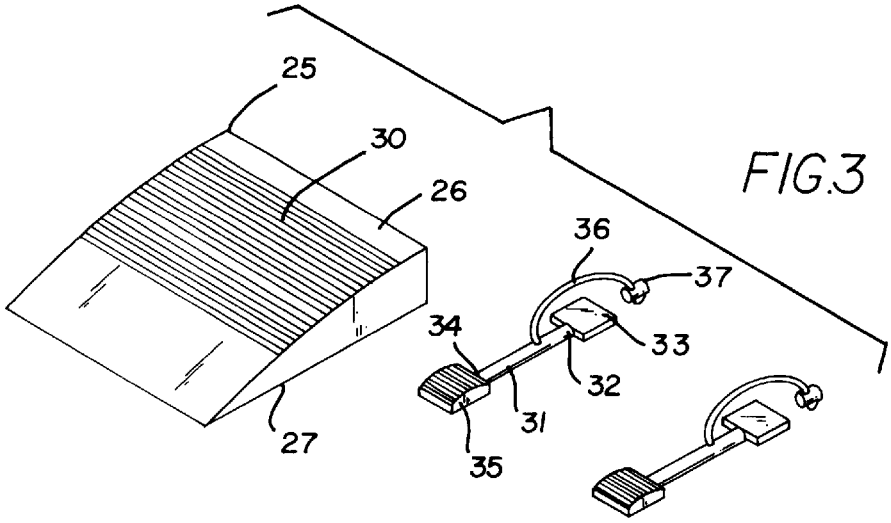
FIG.3
FIG.4
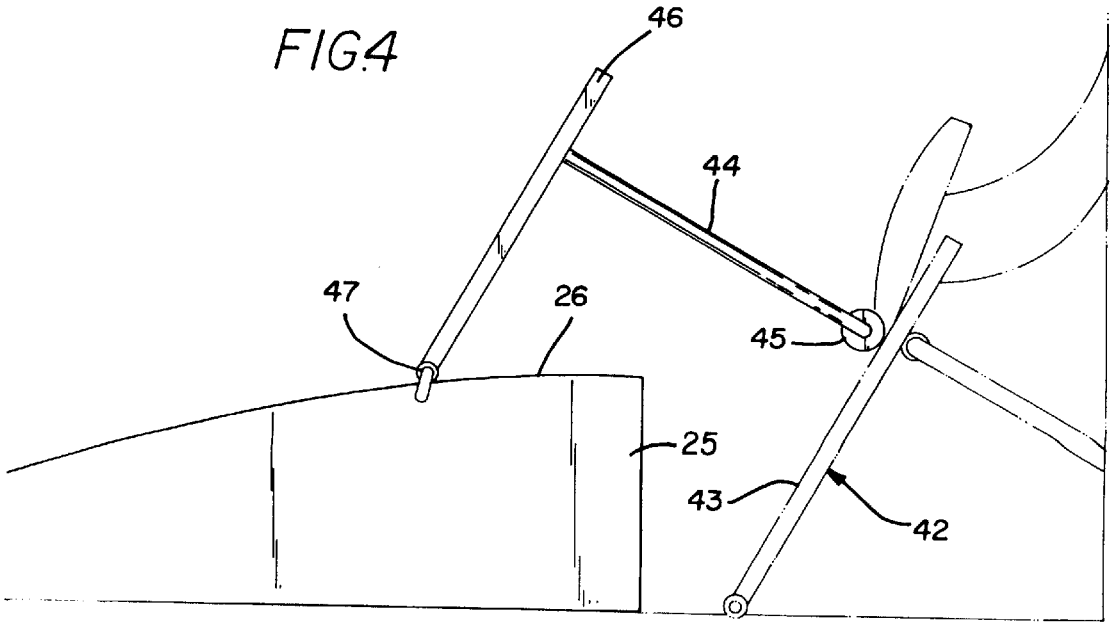

FOOT PEDAL EXTENSION SYSTEM

BACKGROUND OF THE INVENTION

1. Field of the Invention

The present invention relates to vehicular pedal extensions and more particularly pertains to a new foot pedal extension system for permitting a short user to reach the foot pedals of a vehicle comfortably.

2. Description of the Prior Art

The use of vehicular pedal extensions is known in the prior art. More specifically, vehicular pedal extensions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,626,785; U.S. Pat. No. 5,461,939; U.S. Pat. No. 3,288,239; U.S. Pat. No. 3,630,100; U.S. Pat. No. 4,450,733; and U.S. Pat. No. 3,541,881.

While these devices fulfill their respective, particular objectives and requirements, the aforementioned patents do not disclose a new foot pedal extension system. The inventive device includes a foot pedal of a vehicle with a pivot arm and a foot pad coupled to a lower end of the pivot arm. The pivot arm of the foot pedal has an upper end pivotally coupled to the vehicle. An elongate extension arm has an inner end coupled to the pivot arm of the foot pedal between the upper and lower ends of the pivot arm. The extension arm is outwardly extended from the pivot arm of the foot pedal in a direction towards the foot pad of the foot pedal. An extension pad is coupled to an outer end of the extension arm located distal the inner end of the extension arm.

In these respects, the foot pedal extension system according to the present invention substantially departs from the conventional concepts and designs of the prior art, and in so doing provides an apparatus primarily developed for the purpose of permitting a short user to reach the foot pedals of a vehicle comfortably.

SUMMARY OF THE INVENTION

In view of the foregoing disadvantages inherent in the known types of vehicular pedal extensions now present in the prior art, the present invention provides a new foot pedal extension system construction wherein the same can be utilized for permitting a short user to reach the foot pedals of a vehicle comfortably.

The general purpose of the present invention, which will be described subsequently in greater detail, is to provide a new foot pedal extension system apparatus and method which has many of the advantages of the vehicular pedal extensions mentioned heretofore and many novel features that result in a new foot pedal extension system which is not anticipated, rendered obvious, suggested, or even implied by any of the prior art vehicular pedal extensions, either alone or in any combination thereof.

To attain this, the present invention generally comprises a foot pedal of a vehicle with a pivot arm and a foot pad coupled to a lower end of the pivot arm. The pivot arm of the foot pedal has an upper end pivotally coupled to the vehicle. An elongate extension arm has an inner end coupled to the pivot arm of the foot pedal between the upper and lower ends of the pivot arm. The extension arm is outwardly extended from the pivot arm of the foot pedal in a direction towards the foot pad of the foot pedal. An extension pad is coupled to an outer end of the extension arm located distal the inner end of the extension arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot pedal extension system apparatus and method which has many of the advantages of the vehicular pedal extensions mentioned heretofore and many novel features that result in a new foot pedal extension system which is not anticipated, rendered obvious, suggested, or even implied by any of the prior art vehicular pedal extensions, either alone or in any combination thereof.

It is another object of the present invention to provide a new foot pedal extension system which may be easily and efficiently manufactured and marketed.

It is a further object of the present invention to provide a new foot pedal extension system which is of a durable and reliable construction.

An even further object of the present invention is to provide a new foot pedal extension system which is susceptible of a low cost of manufacture with regard to both materials and labor, and which accordingly is then susceptible of low prices of sale to the consuming public, thereby making such foot pedal extension system economically available to the buying public.

Still yet another object of the present invention is to provide a new foot pedal extension system which provides in the apparatuses and methods of the prior art some of the advantages thereof, while simultaneously overcoming some of the disadvantages normally associated therewith.

Still another object of the present invention is to provide a new foot pedal extension system for permitting a short user to reach the foot pedals of a vehicle comfortably.

Yet another object of the present invention is to provide a new foot pedal extension system which includes a foot pedal of a vehicle with a pivot arm and a foot pad coupled to a lower end of the pivot arm. The pivot arm of the foot pedal has an upper end pivotally coupled to the vehicle. An elongate extension arm has an inner end coupled to the pivot arm of the foot pedal between the upper and lower ends of the pivot arm. The extension arm is outwardly extended from the pivot arm of the foot pedal in a direction towards the foot pad of the foot pedal. An extension pad is coupled to an outer end of the extension arm located distal the inner end of the extension arm.

Still yet another object of the present invention is to provide a new foot pedal extension system that lets shorter users easily reach the foot pedals of a vehicle without undue stretching or sitting on the edge of the driver's seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the embodiment of FIG. 1 detached from the foot pedal of a vehicle.

FIG. 4 is a schematic side view of the optional gas pedal embodiment of the present invention.

DESCRIPTION OF THE PREFERRED EMBODIMENT

Figure 1:
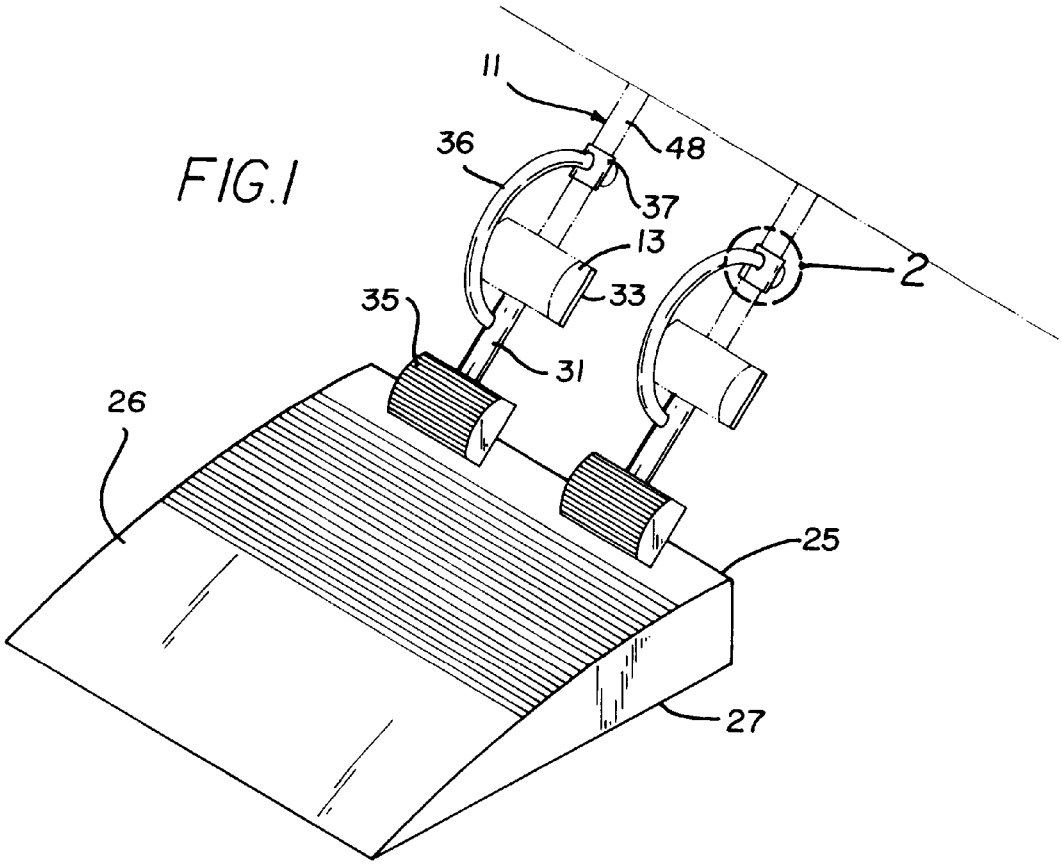
FIG. 1 is a schematic perspective view of one embodiment of a new foot pedal extension system according to the present invention.

With reference now to the drawings, and in particular to FIGS. 1 through 6 thereof, a new foot pedal extension system embodying the principles and concepts of the present invention and generally designated by the reference numeral 10 will be described.

As best illustrated in FIGS. 1 through 6, the foot pedal extension system 10 generally comprises a foot pedal 11 of a vehicle with a pivot arm 48 and a foot pad 13 coupled to a lower end 14 of the pivot arm 48. The pivot arm 48 of the foot pedal 11 has an upper end 12 pivotally coupled to the vehicle. An elongate extension arm 15 has an inner end 16 coupled to the pivot arm 48 of the foot pedal 11 between the upper and lower ends 12,14 of the pivot arm 48. The extension arm 15 is outwardly extended from the pivot arm 48 of the foot pedal 11 in a direction towards the foot pad 13 of the foot pedal 11. An extension pad 17 is coupled to an outer end 18 of the extension arm 15 located distal the inner end 16 of the extension arm 15.

In closer detail, the foot pedal extension system 10 for a vehicle comprises a foot pedal 11 of a vehicle with a pivot arm 48 and a foot pad 13 coupled to a lower end 14 of the pivot arm 48. The pivot arm 48 of the foot pedal 11 has an upper end 12 pivotally coupled to the vehicle. A generally straight elongate extension arm 15 has an inner end 16 coupled to the pivot arm 48 of the foot pedal 11 between the upper and lower ends 12,14 of the pivot arm 48. The extension arm 15 is outwardly extended from the pivot arm 48 of the foot pedal 11 in a direction towards the foot pad 13 of the foot pedal 11. Ideally, the longitudinal axis of the extension arm 15 is extended at an acute angle from the pivot arm 48 of the foot pedal 11.

An extension pad 17 is coupled to an outer end 18 of the extension arm 15 located distal the inner end 16 of the extension arm 15. The foot pad 13 of the foot pedal 11 is located in a vertical plane positioned generally at a midpoint between the inner and outer ends 16,18 of the extension arm 15. The extension pad 17 and the foot pad 13 of the foot pedal 11 each have a first face 19,20 facing a driver's seat of the vehicle designed for placing a foot of a driver thereon generally lie in generally parallel planes with one another. In use, pressing on the extension pad 17 depresses the foot pedal 11 of the vehicle. Ideally, the first face 20 of the extension pad 17 has a plurality of lateral ridges 21 designed for frictionally enhancing the face of the extension pad 17 with respect to a smooth surface to help prevent slipping of a foot of a user resting on the face of the extension pad 17.

Preferably, an arcuate support arm 22 is provided having a pair of opposite ends 23,24. One of the ends 23 of the support arm 22 is coupled to the pivot arm 48 of the foot pedal 11 between the upper end 12 of the pivot arm 48 and the inner end 16 of the extension arm 15. Another of the ends 24 of the support arm 22 is coupled to the extension arm 15 between the inner and outer ends 16,18 of the extension arm 15. The ends 23,24 of the support arm 22 define an obtuse angle therebetween has a vertex at the union of the pivot arm 48 and the inner end 16 of the extension arm 15. In use, the support arm 22 is designed for providing additional structural strength to the coupling of the extension arm 15 to the pivot arm 48.

A foot block 25 having upper and lower faces 26,27, and front and back side faces 28,29 is also preferably included in the system 10. The lower face 27 of the foot block 25 is rested on a floorboard of the vehicle such that the extension pad 17 is positioned above the upper face 26 of the foot block 25 and the foot pad 13 of the foot pedal 11 is positioned adjacent the front side face 28 of the foot block 25. The upper face 26 of the foot block 25 is designed for resting the feet of a driver user thereon to help elevate their legs so that no stretching is required for the driver user to reach the extension pad 17.

Preferably, the upper and lower faces 26,27 of the foot block 25 lie in planes extending at an acute angle to one another for providing comfort to the feet and legs of the user when rested on the upper face 26 of the foot block 25. Ideally, the acute angle defined between the planes of the upper and lower faces 26,27 of the foot block 25 is about 20 degrees to provide an optimal angle for providing comfort to the feet and legs of the user when rested on the upper face 26 of the foot block 25. The front side face 28 of the foot block 25 lies in a plane extending generally perpendicular to the plane of the lower face 27 of the foot block 25. The back side face 29 of the foot block 25 lies in a plane extending at an acute angle from the lower face 27 of the foot block 25 greater than the acute angle defined between the planes of the upper and lower faces 26,27 of the foot block 25. Ideally, the upper face 26 of the foot block 25 has a plurality of lateral ridges 30 designed for frictionally enhancing the upper face 26 of the foot block 25 with respect to a smooth surface to help prevent slipping of a foot of a user resting on the upper face 26 of the foot block 25.

Figure 2:
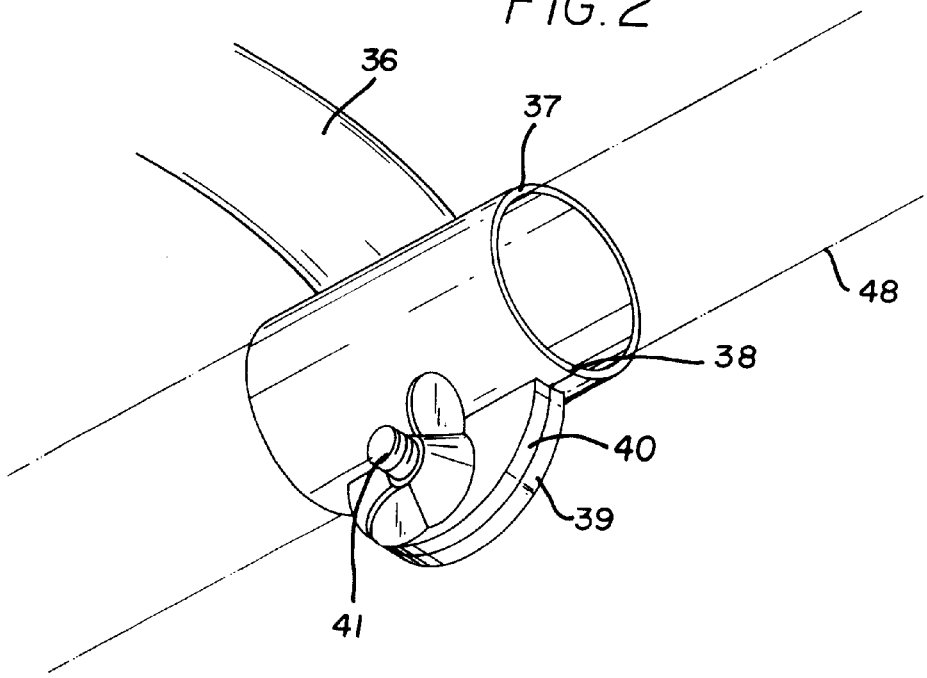
FIG. 2 is a schematic enlarged perspective view of the embodiment of the present invention in FIG. 1 as taken from the circle 2 of FIG. 1.
Figure 5:
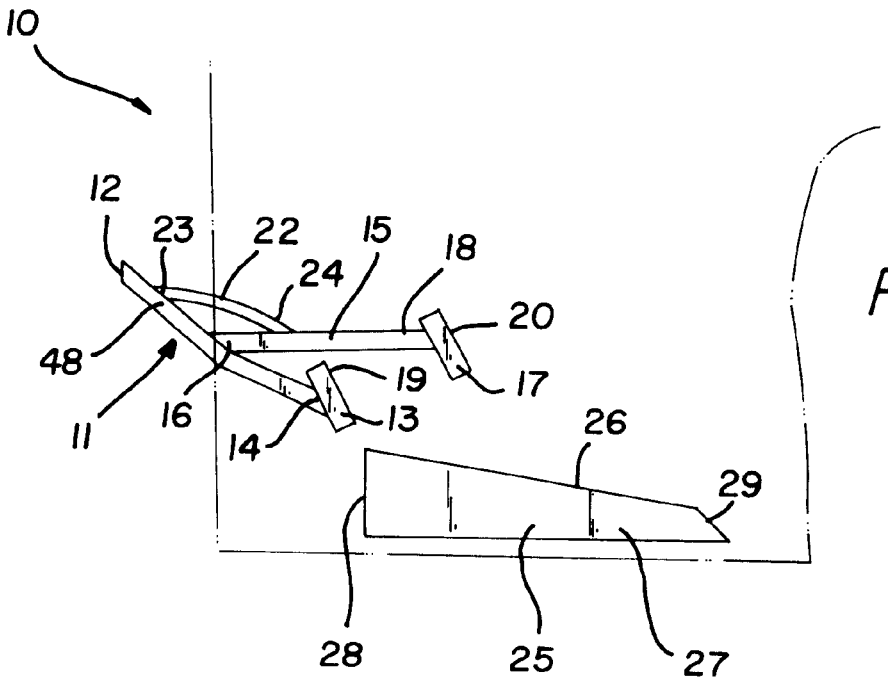
FIG. 5 is a schematic side view of a preferred embodiment of the present invention.
Figure 6:
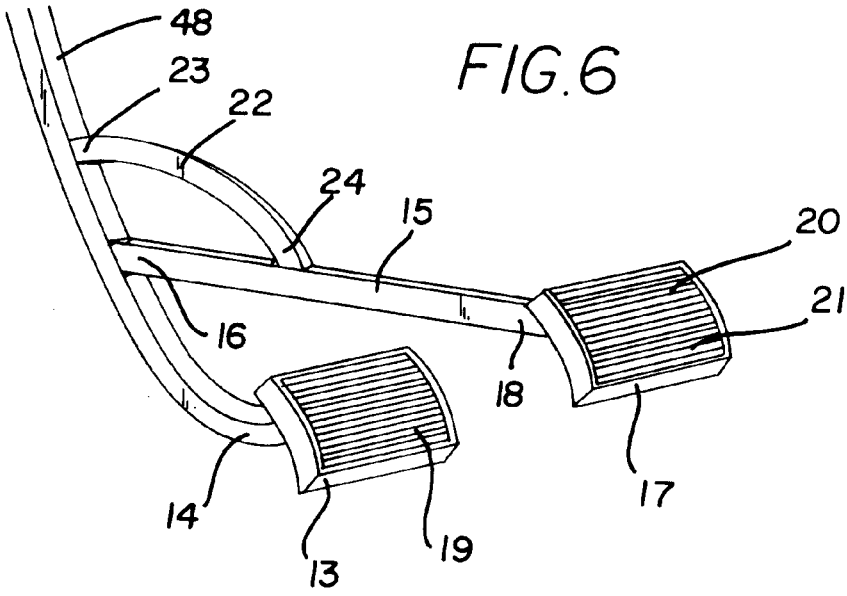
FIG. 6 is a schematic perspective view of the preferred embodiment of the present invention in FIG. 5.

With reference to FIGS. 1, 2, and 3, in another preferred embodiment of the system, an extender arm 31 is provided having a pair of opposite ends 32,34. A first of the ends 32 of the extender arm 31 has a generally rectangular plate 33 coupled thereto. A second of the ends 34 of the extender arm 31 has an extension pad 35 coupled thereto facing a driver's seat of the vehicle designed for placing a foot of a driver thereon. Also provided in this embodiment is an arcuate coupler arm 36 having a pair of opposite ends. One of the end of coupler arm 36 has a tubular coupling sleeve 37 with a longitudinal break 38 therethrough. The pivot arm 48 of the foot pedal 11 is extended through the coupling sleeve 37.

The coupling sleeve 37 has a pair of clamping tabs 39,40 outwardly extending therefrom with the longitudinal break 38 of the coupling sleeve 37 interposed therebetween. A threaded fastener 41 is threadably extended through the clamping tabs 39,40 and secured with a nut such the tightening of the threaded fastener 41 holds coupling sleeve 37 in a fixed position on the pivot arm 48.

Another of the ends of the coupler arm 36 is coupled to the extender arm 31 between the ends of the extender arm 31 such that the coupler arm 36 curves over the foot pad 13 of the foot pedal 11. The plate 33 of the first end 32 of the extender arm 31 abuts a second face of the foot pad 13 of the foot pedal 11 to help maintain the position of the extender arm 31 with respect to the foot pedal 11.

FIG. 4 illustrates In another optional embodiment for a gas pedal 42 of a vehicle having a generally rectangular pad 43 designed for resting the foot of a user thereon. The gas pedal 42 is depressible with the foot of the user. An elongate arm 44 has a rotatably mounted roller 45 at one end, and an extender pad 46 at another end. The roller 45 of the elongate arm 44 is rested on the rectangular pad 43 of the gas pedal 42. The extender pad 46 of the elongate arm 44 has a lower edge pivotally coupled to the upper face 26 of the foot block 25 by a hinge 47. In use, pushing on the extender pad 46 of the elongate arm 44 pivots the extender pad 46 downwards and causes the elongate arm 44 to depress the gas pedal 42, the roller 45 rolls downwards on the rectangular pad 43 of the gas pedal 42 as the gas pedal 42 is depressed by the elongate arm 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot pedal extension system for a vehicle, comprising:

a foot pedal of a vehicle having a pivot arm and a foot pad coupled to a lower end of said pivot arm, said pivot arm of said foot pedal having an upper end pivotally coupled to the vehicle;

an elongate extension arm having an inner end coupled to said pivot arm of said foot pedal between said upper and lower ends of said pivot arm;

said extension arm being outwardly extended from said pivot arm of said foot pedal in a direction towards said foot pad of said foot pedal;

an extension pad being coupled to an outer end of said extension arm located distal said inner end of said extension arm; and an arcuate support arm having a pair of opposite ends, one of said ends of said support arm being coupled to said pivot arm of said foot pedal between said upper end of said pivot arm and said inner end of said extension arm, another of said ends of said support arm being coupled to said extension arm between said inner and outer ends of said extension arm.

2. The foot pedal extension system of claim 1, wherein said extension arm is extended at an acute angle from said pivot arm of said foot pedal.

3. The foot pedal extension system of claim 1, wherein said foot pad of said foot pedal is located in a vertical plane positioned between said inner and outer ends of said extension arm.

4. The foot pedal extension system of claim 1, wherein said extension pad and said foot pad of said foot pedal each have a first face generally lying in generally parallel planes with one another.

5. The foot pedal extension system of claim 1, wherein said ends of said support arm define an obtuse angle therebetween having a vertex at the union of said pivot arm and said inner end of said extension arm.

6. The foot pedal extension system of claim 1, further comprising a foot block having upper and lower faces, said lower face of said foot block being rested on a floorboard of the vehicle such that said extension pad is positioned above said upper face of said foot block.

7. The foot pedal extension system of claim 6, wherein said upper and lower faces of said foot block lie in planes extending at an acute angle to one another.

8. The foot pedal extension system of claim 7, wherein said acute angle defined between the planes of said upper and lower faces of said foot block is about 20 degrees.

9. The foot pedal extension system of claim 6, wherein said upper face of said foot block has a plurality of lateral ridges adapted for frictionally enhancing said upper face of said foot block with respect to a smooth surface to help prevent slipping of a foot of a user resting on said upper face of said foot block.

* * * * *